US010550489B2

(12) United States Patent
Willit et al.

(10) Patent No.: US 10,550,489 B2
(45) Date of Patent: Feb. 4, 2020

(54) ACTINIDE AND RARE EARTH DRAWDOWN SYSTEM FOR MOLTEN SALT RECYCLE

(71) Applicants: James L. Willit, Batavia, IL (US); Magdalena M. Tylka, Willow Springs, IL (US); Mark A. Williamson, Naperville, IL (US); Stanley G. Wiedmeyer, Glen Ellyn, IL (US); Javier Figueroa, Andover, KS (US)

(72) Inventors: James L. Willit, Batavia, IL (US); Magdalena M. Tylka, Willow Springs, IL (US); Mark A. Williamson, Naperville, IL (US); Stanley G. Wiedmeyer, Glen Ellyn, IL (US); Javier Figueroa, Andover, KS (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 497 days.

(21) Appl. No.: 15/206,914

(22) Filed: Jul. 11, 2016

(65) Prior Publication Data

US 2018/0010256 A1 Jan. 11, 2018

(51) Int. Cl.

| | |
|---|---|
| ***C25C 3/34*** | (2006.01) |
| ***C25C 7/06*** | (2006.01) |
| ***C25C 7/00*** | (2006.01) |
| ***C25D 3/66*** | (2006.01) |

(52) U.S. Cl.

CPC ..... *C25C 3/34* (2013.01); *C25C 7/005* (2013.01); *C25C 7/06* (2013.01); *C25D 3/66* (2013.01)

(58) Field of Classification Search

CPC ..... C25C 3/34; C25C 7/005

See application file for complete search history.

(56) References Cited

U.S. PATENT DOCUMENTS

| | | | | |
|---|---|---|---|---|
| 7,267,754 | B1 * | 9/2007 | Willit | C25C 3/34 205/46 |
| 2010/0243468 | A1 * | 9/2010 | Mu | C25B 1/26 205/349 |
| 2010/0276297 | A1 * | 11/2010 | Powell, IV | C25B 1/006 205/350 |

FOREIGN PATENT DOCUMENTS

JP 11021690 A * 1/1999

OTHER PUBLICATIONS

Riley et al., "Safeguards Performance Model for Evaluation of Potential Safeguards Strategies Applied to Pyroprocessing Facilities" Nucl. Eng. Des. 301, pp. 157-163 (2016).*

(Continued)

*Primary Examiner* — Brian W Cohen

(74) *Attorney, Agent, or Firm* — Cherskov Flaynik & Gurda, LLC

(57) ABSTRACT

A method for recycling molten salt from electrorefining processes, the method having the steps of collecting actinide metal using a first plurality of cathodes from an electrolyte bath, collecting rare earths metal using a second plurality of cathodes from the electrolyte bath, inserting the collected actinide metal and uranium into the bath, and chlorinating the inserted actinide metal and uranium. Also provided is a system for recycling molten salt, the system having a vessel adapted to receive and heat electrolyte salt, a first plurality of cathodes adapted to be removably inserted into the vessel, a second plurality of cathodes adapted to be removably inserted into the vessel, an anode positioned within the vessel so as to be coaxially aligned with the vessel, and a vehicle for inserting uranium into the salt.

9 Claims, 8 Drawing Sheets

(56) References Cited

OTHER PUBLICATIONS

Williamson et al., "Pyroprocessing Flowsheets for Recycling Used Nuclear Fuel" Nucl. Eng. Technol. 43(4), pp. 329-334 (2011).*
Translation of JP11-021690 (Year: 1999).*
A.F. Laplace et al., Electrodeposition of Uranium and Transuranic Metals (Pu) on Solid Cathode, Nuclear Technology, vol. 163, Sep. 2008.

* cited by examiner

ACTINIDE AND RARE EARTH DRAWDOWN SYSTEM FOR MOLTEN SALT RECYCLE

CONTRACTUAL ORIGIN OF THE INVENTION

The U.S. Government has rights in this invention pursuant to Contract No. DE-AC02-06CH11357 between the U.S. Department of Energy and UChicago Argonne, LLC, representing Argonne National Laboratory.

BACKGROUND OF THE INVENTION

1. Field of the Invention

This invention relates to electrolyte recovery and more specifically, this invention relates to a system and method for recovering electrolyte from used nuclear fuel processes, including uranium and uranium-transuranic alloy product processing.

2. Background of the Invention

Uranium and uranium-transuranic (U/TRU) processing involves the harvesting of uranium and transuranic elements from ore and other feedstocks. Such harvesting often occurs through electrolysis. Electrolyte utilized in this process becomes contaminated with fission products, some of which are rare earth elements. These elements need to be removed before the electrolyte can be recycled for additional harvesting activities.

A need exists in the art for a system and method for thoroughly reclaiming spent electrolyte used in nuclear fuel reprocessing. The system and method should integrate several element harvesting procedures in as few steps as possible. Furthermore, the system and method should eliminate or at least minimize secondary waste streams, such as off gases which may be generated. Also, the integrated system should be confined to as small a footprint as possible in the processing facility.

SUMMARY OF INVENTION

An object of the invention is to recover electrolyte from uranium and uranium-transuranic processing that overcomes many of the drawbacks of the prior art.

Another object of the invention is to provide a system and method for removing actinides and rare earths from electrolyte used in uranium and transuranium processing. A feature of the invention is utilizing electrolysis to first remove actinide as elemental metal (and their associated chlorine anions as chlorine gas), then rare earths as elemental metals (and their associated chlorine anions as chlorine gas), from the electrolyte. The chlorine gas is then used to regenerate the electrolyte by chlorinating uranium and transuranium elements in the electrolyte. An advantage of the invention is that it combines three operations in one system.

Still another object of the invention is to provide a streamlined method for reclaiming electrolyte used in nuclear fuel processing. A feature of the invention is that separate sets of electrodes are applied to the same electrolyte bath to sequentially remove actinides, then rare earth elements. An advantage of the invented method is that only one, stationary electrolyte bath vessel is utilized to accommodate different mobile electrode sets, thereby increasing efficiency and safety during harvesting operations. Another advantage is that this configuration minimizes the foot print (e.g., floor space) required for this invented method within a processing facility.

Yet another object of the invention is to provide a system and method for reclaiming electrolyte used in processing nuclear fuel. A feature of the invention is that the solvent chloride salt components are recycled for further use in subsequent fuel processing. An advantage of the invention is that recycling the electrolyte maintains the mass balances required for efficient nuclear fuel processing.

Briefly, the invention provides a method for recycling molten salt from electrorefining processes, the method comprising collecting actinide metals using a first plurality of cathodes from an electrolyte bath, collecting rare earth metals using a second plurality of cathodes from the electrolyte bath, inserting the collected actinide metal and additional uranium into the bath, and re-chlorinating the recovered actinides.

Also provided is a system for recycling molten salt, the system comprising a vessel adapted to receive and heat electrolyte salt, a first plurality of cathodes adapted to be removably inserted into the vessel, a second plurality of cathodes adapted to be removably inserted into the vessel, an anode positioned within the vessel so as to be coaxially aligned with the vessel; and a vehicle for positioning elemental metal into the salt.

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

The foregoing summary, as well as the following detailed description of certain embodiments of the present invention, will be better understood when read in conjunction with the appended drawings.

All numeric values are herein assumed to be modified by the term "about", whether or not explicitly indicated. The term "about" generally refers to a range of numbers that one of skill in the art would consider equivalent to the recited value (e.g., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

The following detailed description should be read with reference to the drawings in which similar elements in different drawings are numbered the same. The drawings, which are not necessarily to scale, depict illustrative embodiments and are not intended to limit the scope of the invention.

As used herein, an element or step recited in the singular and preceded with the word "a" or "an" should be understood as not excluding plural said elements or steps, unless such exclusion is explicitly stated. As used in this specification and the appended claims, the term "or" is generally employed in its sense including "and/or" unless the content clearly dictates otherwise.

Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The instant invention combines three separate pyrochemical processes within one system. Generally, the invented system and method facilitate the electrodeposition of actinides and lanthanides onto cathodes, the rehabilitation of spent salt, and subsequent treatment of refurbished salt within a single electrolysis vessel.

The electrochemistry of the actinide and rare earth drawdown is defined in the following chemical equations:

Cathode Process:

$$M^{3+}\ (\text{I, in electrolyte})+3e^{-}\rightarrow M(c), \qquad \text{Equation 1}$$

where M is an actinide or rare earth. (c) indicates a "condensed" phase since the actinides and rare earths can be deposited as a solid or liquid, depending on the melting point of the element and the bath temperature.

Anode Process:

$$2Cl^{-}\ (\text{I, in electrolyte})\rightarrow Cl_2(g)+2e^{-}. \qquad \text{Equation 2}$$

Overall reaction:

$$MCl_3\ (\text{I, in electrolyte})\rightarrow M(c)+1.5Cl_2(g). \qquad \text{Equation 3}$$

Additional detail of the drawdown chemistry can be found in Laplace et al., Nuclear Technology 163, pp 366-372 (September 2008), the entirety of which is incorporated herein by reference.

Figure 1:
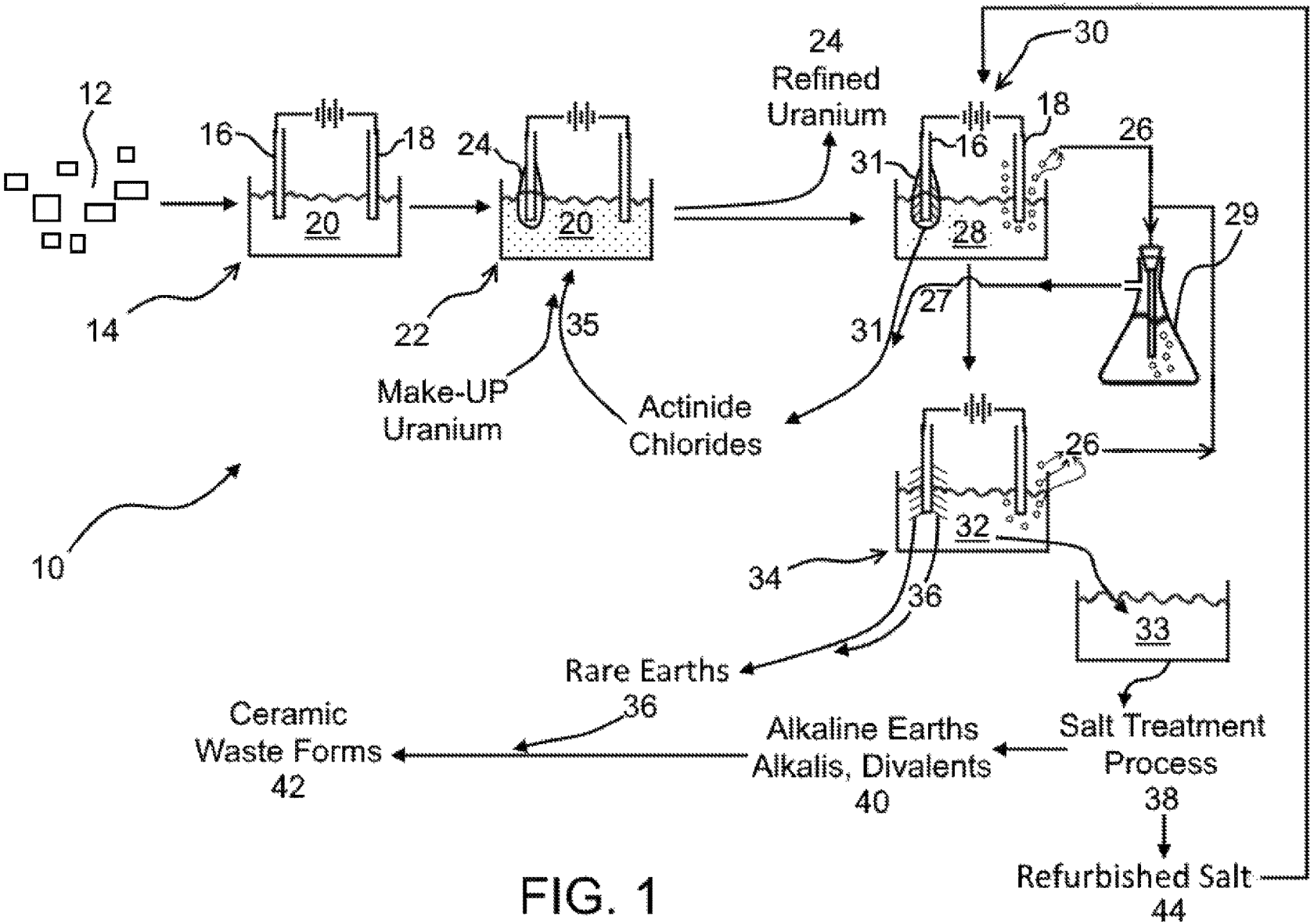
FIG. 1 is a schematic view of the drawdown process, in accordance with features of the present invention.

FIG. 1 depicts a method, designated as numeral 10, for drawing down actinides and rare earths from electrolyte used to refine uranium and transuranic elements. Prior to drawdown in an electrorefiner 22, used fuel 12 containing uranium, transuranic oxides (mostly $UO_2$ and $PuO_2$), and fission products (mostly oxides from light water or thermal reactors) are placed into an electroreducer 14, so as to convert the oxides into metals. (Used metallic fuel from fast reactors does not need reducing and so can be placed directly into the electrorefiner 22, discussed below). The electroreducer 14 comprises a cathode 16, an anode 18, and electrolyte 20.

Subsequently, the metal is subjected to an electrorefining process 22 whereby electrolysis causes target metal 24 to accumulate onto the cathode 16. In this step, a first voltage is applied so that actinides such as uranium and transuranic elements accumulate on the cathode for removal. Given this first voltage, rare earths and other fission products remain in the salt. Once the refined target metal 24 is removed from the electrorefiner, post-refining electrolyte 28 (e.g., LiCl—KCl) remains, containing actinide chlorides, rare earth chlorides, and other fission product chlorides. The fission products accumulate in the salt after multiple batches of fuel are processed.

A salient feature of the method and system is recovery of actinide-chlorides from the post-refining electrolyte 28 prior to fission product recovery. This recovery process minimizes actinide loss to any final waste forms. As such, the final waste forms, discussed infra, would comprise durable glass-bonded ceramic encapsulating rare earths and active metal fission products.

Inasmuch as the actinides are present in the salt as soluble actinide chlorides, they are recovered as reduced actinide metal 31 via additional electrolysis 30. Concomitantly, chlorine gas 26 is formed at the anode. The chlorine gas 26 is removed from the electrolysis cell and scrubbed 29 in situ to form a stable chloride (e.g., $CaCl_2$) which can be discharged as waste or recycled. An inert gas is bubbled through the spent electrolyte during this actinide harvesting step to both stir the liquor and also provide a carrier and diluent for the chlorine gas 26.

In the actinide recovery step 30, the cell potential is selected so that actinide recovery from the salt is maximized and rare earth recovery is minimized. To maximize actinide recovery, the cell may be operated with a cathode potential slightly positive of the reduction potential for gadolinium (e.g., approximately −1.83 V vs Ag/AgCl) since gadolinium is the most abundant rare earth fission product in the electrolyte. This protocol minimizes actinide loss to the waste stream while leaving the bulk of the rare earth elements in the salt phase at this point in the process.

The remaining electrolyte salt 32 is subjected to the same electrolysis process used for the actinide drawdown, but at a more negative (i.e., more reducing) potential vs. Ag/AgCl. The potential is suitable to accumulate, collect, plate out or otherwise collect rare earths 36 at the cathode. The actinide drawdown process 30 and the rare earth recovery process 34 may be conducted in series in the same process vessel but using different cathodes. As was the case in the first reclamation step 30, inert gas is utilized in this second step 34 to keep the liquor stirred and to aid in the collection and expulsion of chlorine gas from the liquor.

A myriad of anode materials are suitable for the drawdown process, including inert materials such that the anode is not consumed during drawdown.

Oxidant Production

Detail

Oxidant (e.g., actinide trichlorides, such as uranium trichloride, neptunium trichloride, and plutonium trichloride or combinations thereof) and or dichlorides (e.g., Americium dichloride) is needed in the electrorefining process. Suitable trichlorides and dichlorides incorporate actinide cations between Ac and Lr, and rare earth cations preferably between Ce and Lu in the periodic table. These salts serve as transport species to facilitate passage of the actinides (dissolved at the anode) through the electrolyte to the cathode of the system where they are reduced to elemental metal. The electrolyte in the electrorefiner originally contains approximately seven weight percent $U^{3+}$ as $UCl_3$. As used fuel is processed in the electrorefiner, the transuranics and rare earth metals as well as other fission products (e.g., cesium) are oxidized and dissolve in the electrolyte, thereby displacing the $U^{3+}$ cation in the chloride salt. Eventually additional oxidant ($U^{3+}$) needs to be added to the system so that uranium recovery, and transuranic and rare earth dissolution can continue. Equation 4 infra, reflects the chemistry associated with maintaining this correct mass balance.

$$UCl_3\ (\text{I, in electrolyte})+M(s)\rightarrow MCl_3\ (\text{I, in electrolyte})+U(s) \qquad \text{Equation 4}$$

where M is a trivalent transuranic- or rare earth elemental metal or alloy metal. Similar equations can be written for the consumption of uranium trichloride by divalent transuranic and rare earth elements as well as other active metal fission products such as cesium and strontium.

A small fraction of the uranium metal collected in the refining process along with actinide metals recovered during the actinide drawdown process are used to produce oxidant (e.g., make-up actinide trichloride) for the electrorefiner 22. The actinides, submerged in a fraction of the electrolyte recovered from the rare earth drawdown process, are chlorinated at 650° C. to form actinide trichlorides. The resulting solution contains actinide trichlorides at a concentration much higher than in the refiner and the entire solution can be transferred to the electrorefiner to maintain the desired actinide trichloride concentration in the refiner. Alternatively, trichlorides and dichlorides can be formed in the electrorefiner at those elevated temperatures, prior to beginning the electrolysis process. In this instance, elemental and or alloyed metal can be added to the salt, then subjected to chlorine gas. The rare earth elements 36 recovered from the electrolyte are combined with alkalis, alkaline earths and divalent rare earths 40 recovered in a salt treatment process 38, described infra. This combination of fission products is used to generate a feedstock 42 for ceramic waste forms.

Electrolyte salt 33 discharged from the rare earth drawdown process is transferred to a salt treatment process 38 to allow the alkali, alkaline earth and divalent rare earth fission products 40 to be recovered and discharged to the ceramic waste process.

Fractional crystallization, step 40, may be used to achieve the desired separation of the remaining fission products from the bulk salt 33. Fractional crystallization is the segregation or isolation of crystals from a melt. In this application of the process, as the temperature of the electrolyte salt is lowered from 650° C. to approximately 500° C., a liquid phase is formed that is rich in cesium chloride, strontium chloride and divalent rare earth chlorides. At a temperature of 500° C., a solid phase rich in lithium chloride is in equilibrium with a liquid phase rich in cesium chloride and strontium chloride.

An aluminosillicate-based ceramic that results in the formation of sodalite, a naturally occurring mineral containing chloride, is the preferred matrix for the disposal of waste salt from the pyrochemical process. Salt enriched in cesium, strontium and divalent rare earth chlorides from the salt treatment process and rare earth metals from the rare earth drawdown process are encapsulated in a glass-bonded sodalite to yield a high-level waste form 42 for geologic disposal.

The liquid phase or active metal waste salt is decanted from the solid phase and transferred to the ceramic waste process. The remaining solid phase 44 is refurbished salt that is re-melted, recovered from the process vessel and recycled to the drawdown vessel 30 for oxidant production. Once the oxidant production step has been completed, the refurbished salt with actinide chlorides is transferred to the electrorefiner, 22.

The process does not yield a pure lithium chloride phase but the amount of fission product chlorides contained in the lithium chloride is reduced. At steady state operation of the fuel treatment system, this process allows for the recovery and disposal of an amount of alkali, alkaline earth and divalent rare earth fission products equivalent to those in the feed.

The following portion of this specification describes system hardware capable of being operated and maintained remotely. In addition, the system is designed in modules for ease of maintenance and repair.

The system is capable of being installed and serviced using remote handling devices and complying with ASTM C1217-00, and ASTM C1533-08.

The system provides that all operations are conducted robotically by program or manually via cameras.

The drawdown system can be disassembled into modules for service and lifted or moved by an overhead material handling crane.

Exterior surfaces of the system do not exceed 150° C., even during extended process times.

The vessel is rated for routine operation at 650° C.

Off-gas from the system is removed via a dedicated gas handling line to limit the amount of gas discharged to the hot-cell and provide a means to scrub the chlorine gas.

The system provides replacement of cathode cups and replenishment of uranium for oxidation.

An embodiment of the system features two sets of cathode bus bars for each drawdown operation.

On completion of the rare earth drawdown, cathodes are removed and emptied into the salt transport tank for transport to the salt treatment process. During the oxidant production process, the excess chlorine gas is captured at the top of the vessel and directed to chlorine scrubbers. When the three processes are complete, the remaining salt is vacuum transferred to the oxidant storage tank.

Secondary Containment

Vessel Detail

The secondary containment vessel is constructed from material that can withstand temperatures in excess of 700° C. Exemplary materials include, but are not limited to 316 series stainless steel, Inconel, Monel, and alloys and combinations thereof. The secondary vessel contains the salt in the event the primary vessel develops a leak or is otherwise breached.

Containment Vessel

Detail

Figure 2:
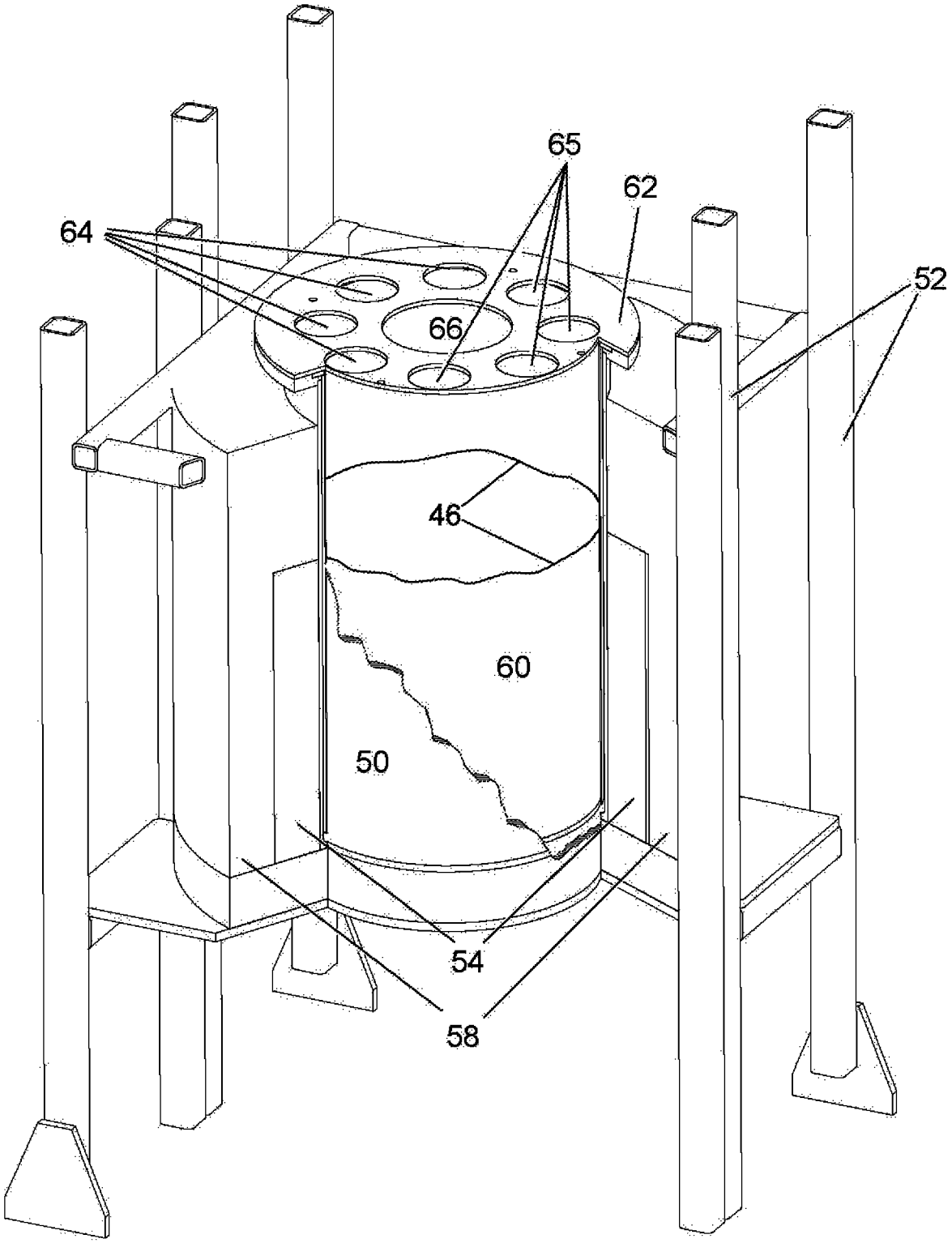
FIG. 2 is a perspective view of a molten bath vessel, in accordance with features of the present invention.

FIG. 2 depicts the containment vessel (designated as numeral 50). Generally cylindrical, the vessel may be removably received in a support frame 52. The containment vessel 50 is further supported by a block of insulating material so as to prevent heat conductance to the frame. Generally, the frame helps maintain the vessel in an upright position, at least initially until any substantial weight is added to the vessel. The frame 52 also supports lifting motors and fixtures for inserting and removing electrode assemblies.

In thermal communication with the vessel are resistance type heaters 54. The heaters may comprise resistance coils wrapped around a lower periphery of the vessel 50 up to approximately the level 46 of the salt bath contained within the vessel. Other type heaters are shaped to be conformal with the outer surface of the vessel 50, such as commercially available clam shell, barrel or band heaters. Conformal heaters are commercially available such as through Watlow Electric Manufacturing Company (St. Louis, Mo.). Generally, the heaters impart heat to the vessel system sufficient to maintain the salt bath in a molten condition. Temperatures of between approximately 650° C. and 750° C. are suitable.

Encapsulating, enveloping or otherwise overlaying the heaters 54 is a layer of insulation 58. The insulation 58 minimizes heat loss from the salt bath and reduces heat conductance to the frame and environment immediately adjacent the exterior surface of the vessel. The insulation minimizes heat conductance from the salt bath such that the frame and its immediate surroundings get no warmer than about 150° C.

Typical operation scenarios are at ambient (e.g., environmental or atmospheric) pressures. As such, the vessel 50 is often not sealed from the environment, and therefore not required to be pressure- or vacuum-compliant.

Primary containment of the melt is with a liner 60 within the vessel such that the liner is in contact with the interior surface of the secondary containment vessel 50. In an embodiment of the invention, the cross section of the liner is less than the cross section of the containment vessel so as to be slidably received by it. While an annular space exists between the so nested liner and the vessel to allow for thermal expansion, some contact between the liner and the vessel occurs so as to confer thermal conduction between the liner and the vessel. Thermal conduction is enhanced as the liner expands with heat applied to it. This contact with the secondary vessel facilitates thermal conductance of heat from the heaters 54, through the wall of the secondary vessel 50, and finally through the liner 60 so as to heat the salt to a liquid. The liner 60 defines the primary vessel and is a crucible that directly contacts the salt. Typical constituents of the liner include, but are not limited to, 316 stainless steel, Inconel, or Monel.

A generally flat, circular plate serves as a cover 62 for the secondary containment vessel 50, and therefore the liner 60. The vessel cover 62 is supported by the periphery of the opening of the containment vessel 50. Generally, the cover's weight, along with optional finger stock, positioning fingers or other male female configuration keeps the cover held in place on top of the containment vessel 50.

The purpose of the cover 62 is to reduce heat losses through the top of the vessel. When combined with other components, the vessel cover closes off heat radiation paths, supports subsequent equipment and provides access ports for instrumentation.

Peripheral regions of the cover define apertures 64, 65 for slidably receiving cathodes. A center region of the cover defines an aperture 66 adapted to slidably receive an anode assembly as depicted in FIG. 3, and described infra. In an embodiment of the invention, one set 64 of cathode apertures is dedicated to accommodate cathodes specific for actinide deposition while a second set 65 of apertures is dedicated to accommodate cathodes specific for rare earth deposition. The one set 64 of cathode apertures may define a diameter or cross section that is the same or different than the diameter of the second set 65 of apertures.

As depicted, the one set 64 of cathode apertures are positioned along a first region of the periphery of the lid 62 while the second set 65 of cathode apertures are positioned along a second region of the periphery of the lid 62. The first set 64 of apertures may form a first half circle while the second set 65 of apertures may form a second half circle opposing the first half circle. In this configuration, the two half circles share a common center point, which is defined by the center of the lid and further defined by the anode receiving aperture 66.

An alternative embodiment of the cover defines two distinct halves such that the anode assembly can be positioned first, and each half added afterwards and subsequently reversibly secured to the vessel 60 periphery.

Anode Detail

Figure 3A:
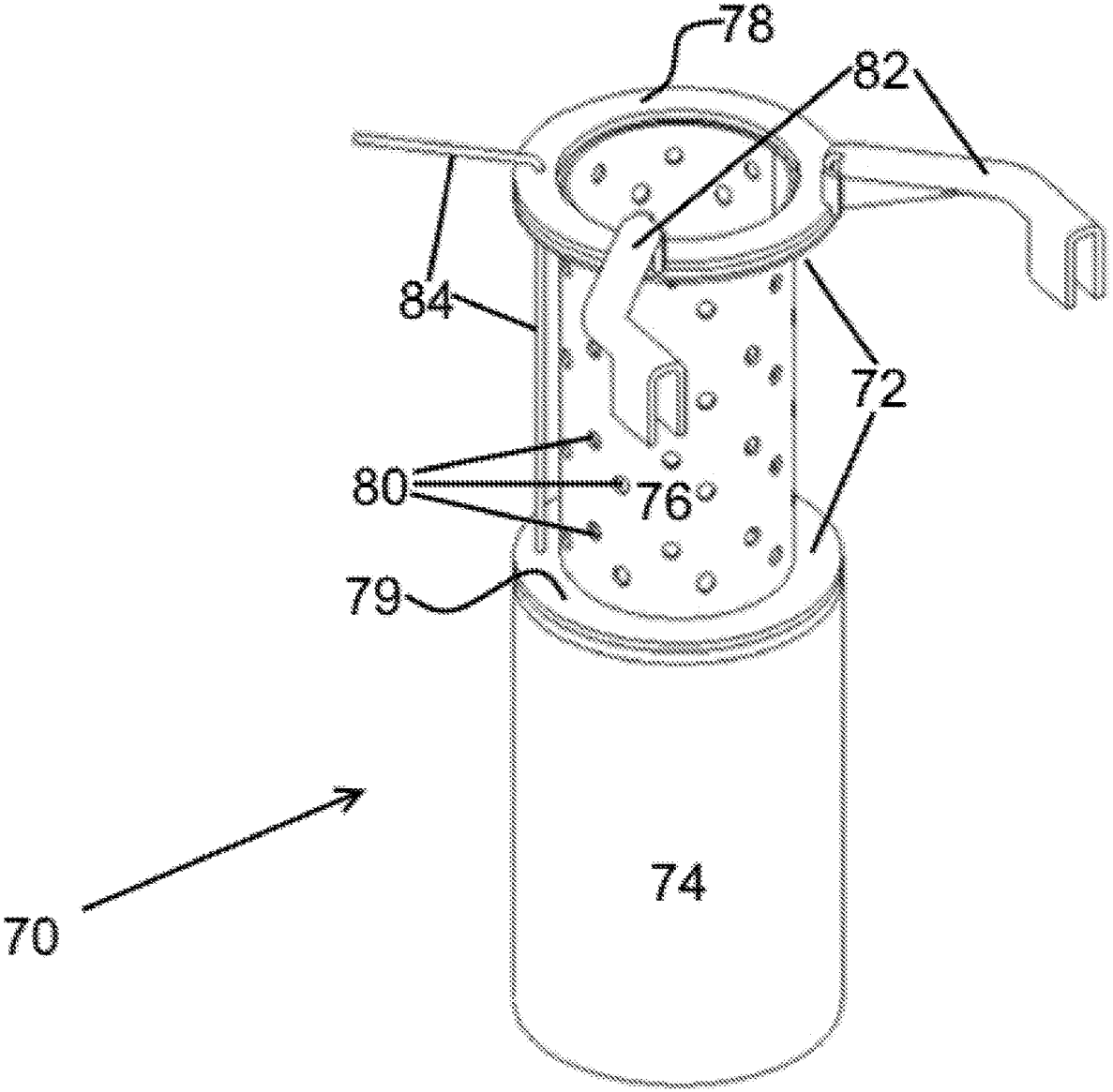
FIGS. 3A-C are perspective views of an anode assembly, in accordance with features of the present invention.
Figure 3B:
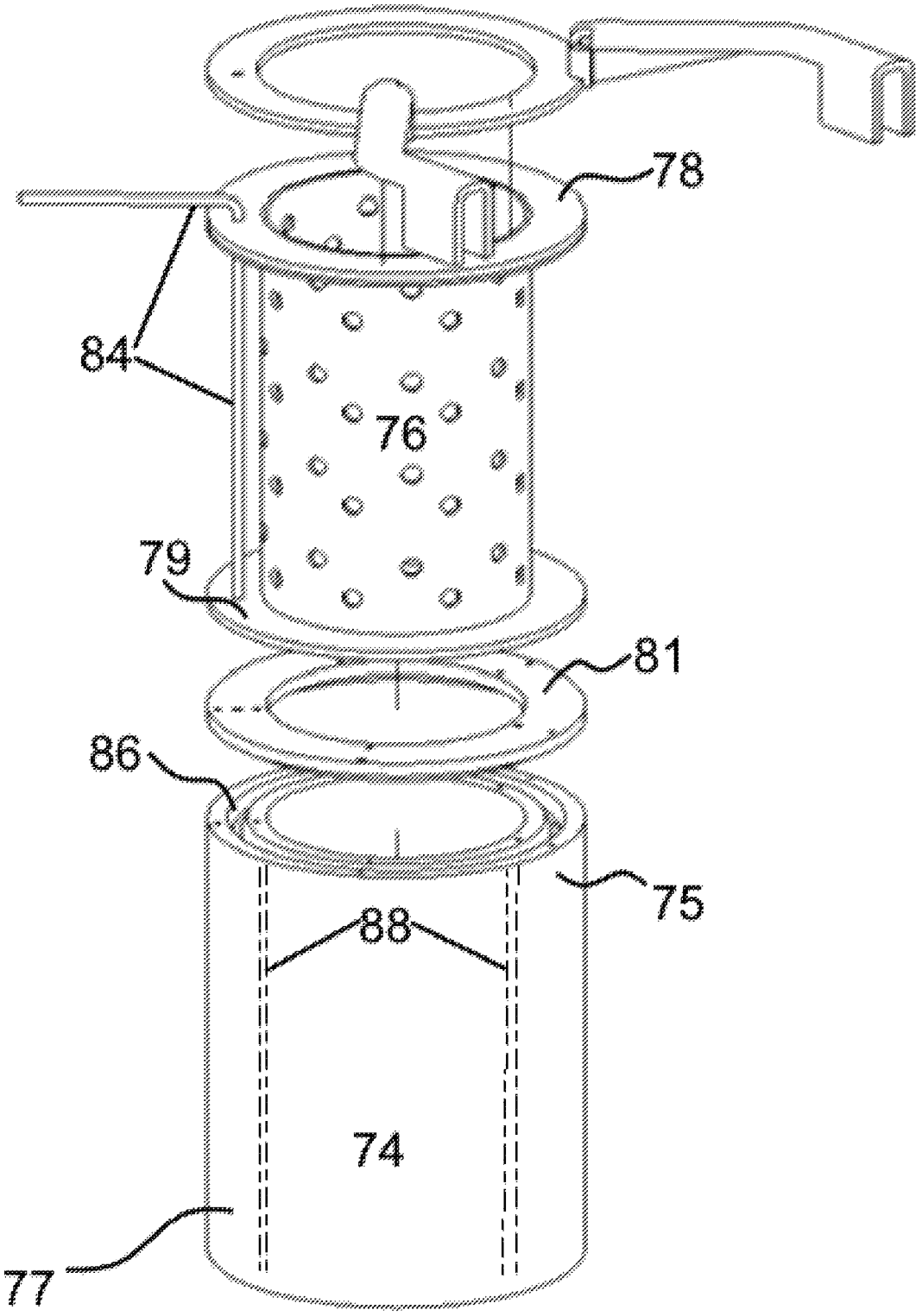
Figure 3C:
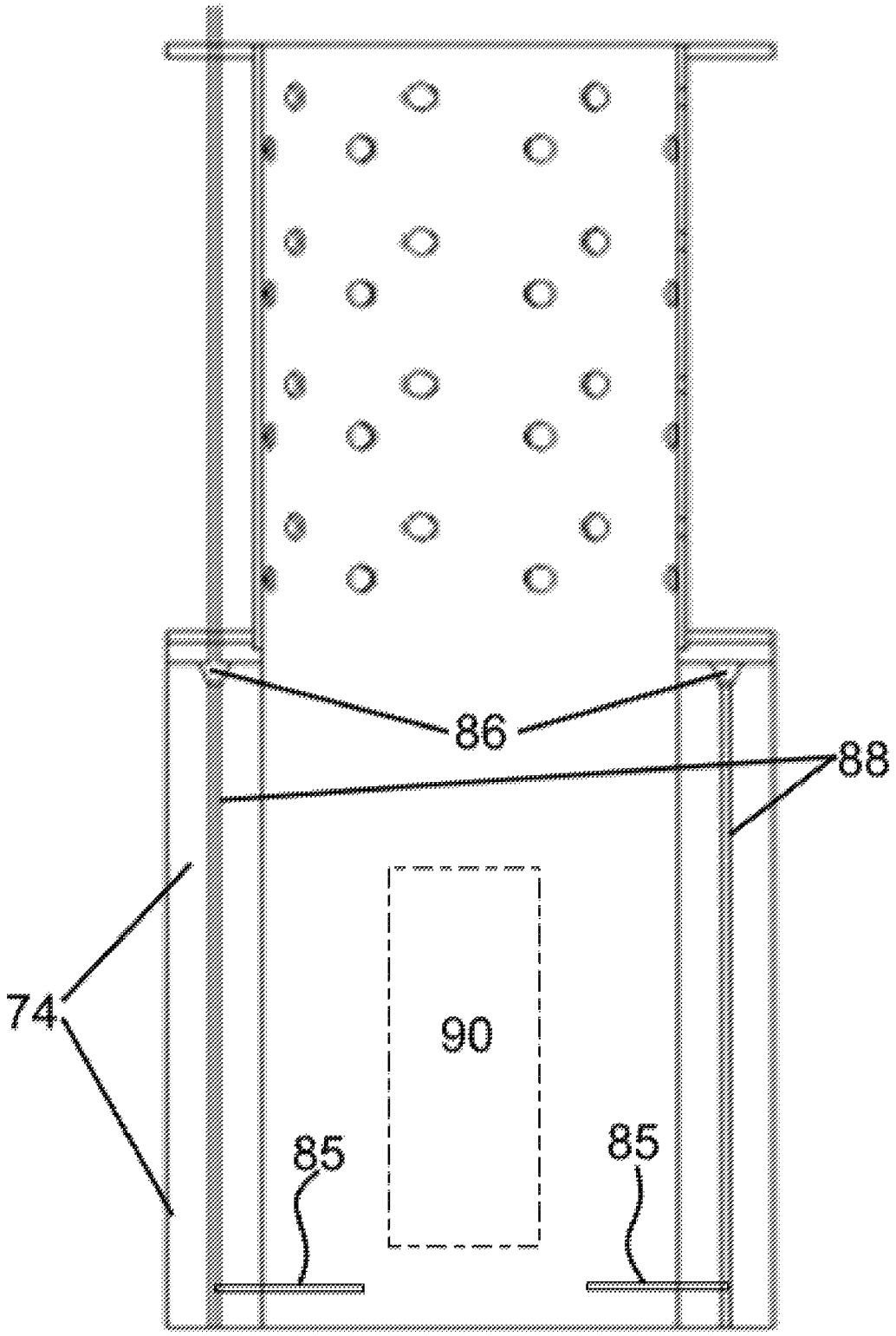

FIGS. 3A-C depict an anode assembly for use in the system, the anode assembly generally designated as numeral 70. The anode works in conjunction with the cathodes to complete the circuit to enable the drawdown process. It is the oxidizing electrode at which chlorine gas is generated during the actinide and rare earth recovery processes. The configuration of the invented anode also provides a path for the chlorine gas to travel to the bottom of the vessel and evenly distribute chlorine gas during oxidant production.

The anode assembly 70 is generally cylindrical in shape with a cross section less than the diameter of the central aperture 66 of the vessel cover 62 so as to be slidably received by same. The anode assembly 70 comprises a weldment portion 72 and the active material portion 74 such that the two portions are coaxially aligned with each other and the vessel 50.

The weldment portion 72 comprises a center cylindrical region 76 terminated at each end with a laterally extending flange 78, 79. The center cylindrical region 76 of the weldment comprises surfaces defining apertures 80. These apertures provide a means for allowing transport of gas between the vessel 50 and the interior void defined by the cylindrical region 76, that void space defining the center cylindrical region 76. The void defines the headspace above the reaction zone in which oxidant production occurs. As such, the headspace is in fluid communication with the reaction zone.

The weldment 72 comprises electrically conductive material such as ferrous containing metal, nickel alloys, stainless steel, etc. A superior portion of the weldment further comprises bus bars 82 to provide current to the anode 74. The bus bars 82 are in electrical communication with the superior or upper flange 78 of the weldment. In an embodiment of the invention, the bus bars are integrally molded with the upper flange 78 of the weldment.

Approximately diametrically opposed to the bus bars 82 is a conduit 84 extending transversely through the superior flange 78, along longitudinally extending regions of the center cylindrical region 76, and through a lower or inferior flange 79. This conduit supplies chlorine gas and/or sparging gas to the bottom of the active material 74 of the anode for even distribution of the gas during oxidant production (step 27 in FIG. 1).

An exemplary active anode material 74 comprises graphite. The active anode material 74 is depicted in cylindrical configuration having a cross section similar to the cross section formed by the inferior flange 79. Like the center cylindrical region 76 above it, the anode active material region 74 defines a first upwardly extending end 75 and a second depending end 77. Regions of the upwardly facing end of the anode 74 define threaded apertures or similar means for attaching to the depending or inferior flange 79 of the weldment. Optionally, a gasket 81 (FIG. 3B) is positioned between the inferior flange 79 and the upwardly directed surface of the graphite cylinder. Regions of the gasket 81 form transverse apertures to allow the chlorine gas/sparging gas conduit 84 to pass there through.

As depicted in FIG. 3B, the upwardly facing end 75 of the anode 74 further defines a groove 86 in fluid communication with the conduit 84, wherein the groove 86 defines an intermediate periphery of the first end of the anode 74. Therefore, the groove 86 circumscribes the opening defining the first end 75 of the anode.

The floor of the groove forms apertures as ingress points to drains or channels 88, those channels depicted in cutaway FIG. 3C. The channels are formed within the bulk of the active material portion 74 of the anode and extend throughout its length terminating at depending ends as egress points. The channels 88 may comprise tunnels formed through the active material portion 74, so as to maximize exposure of the gas to the active material during gas travel through the anode. Alternatively, the channels 88 may comprise conduits adapted to be reversibly received by tunnels formed through the active material portion 74 such that the conduits extend through the entire length of the tunnels so as to physically isolate the gas from the active material during gas traversal through the bulk of the active material.

An embodiment of the invention comprises medially directed conduits 85 with proximal ends in fluid communication with the depending ends of the channels 88 and distal ends positioned below an oxidant metal fuel basket 90. Alternatively, the depending ends of the channels 88 may terminate in nozzles. The diameter of the basket is less than the diameter of the anode aperture 66 formed in the lid (FIG. 2). These egress points in the cylinder reside below the oxidant basket. Generally, the gas egress points route the chlorine gas and sparging gas toward the middle of the void formed by the active material portion 74 of the anode.

These channels 88 facilitate passage and even distribution of chlorine gas to regions of the vessel below the oxidant basket and the actinide cathodes. The conduit 84, groove 86 and channels 88 may also carry relatively inert gas (e.g., helium, argon, neon, etc) to facilitate mixing and sparging of the salt bath during chlorine gas infusion. Sparging with inert gas (relative to the reactants and salt constituents) may be ongoing, for example, before, during, and after chlorine gas infusion. Alternatively, inert gas sparging may be implemented during certain phases only of the drawdown process.

Figure 4:
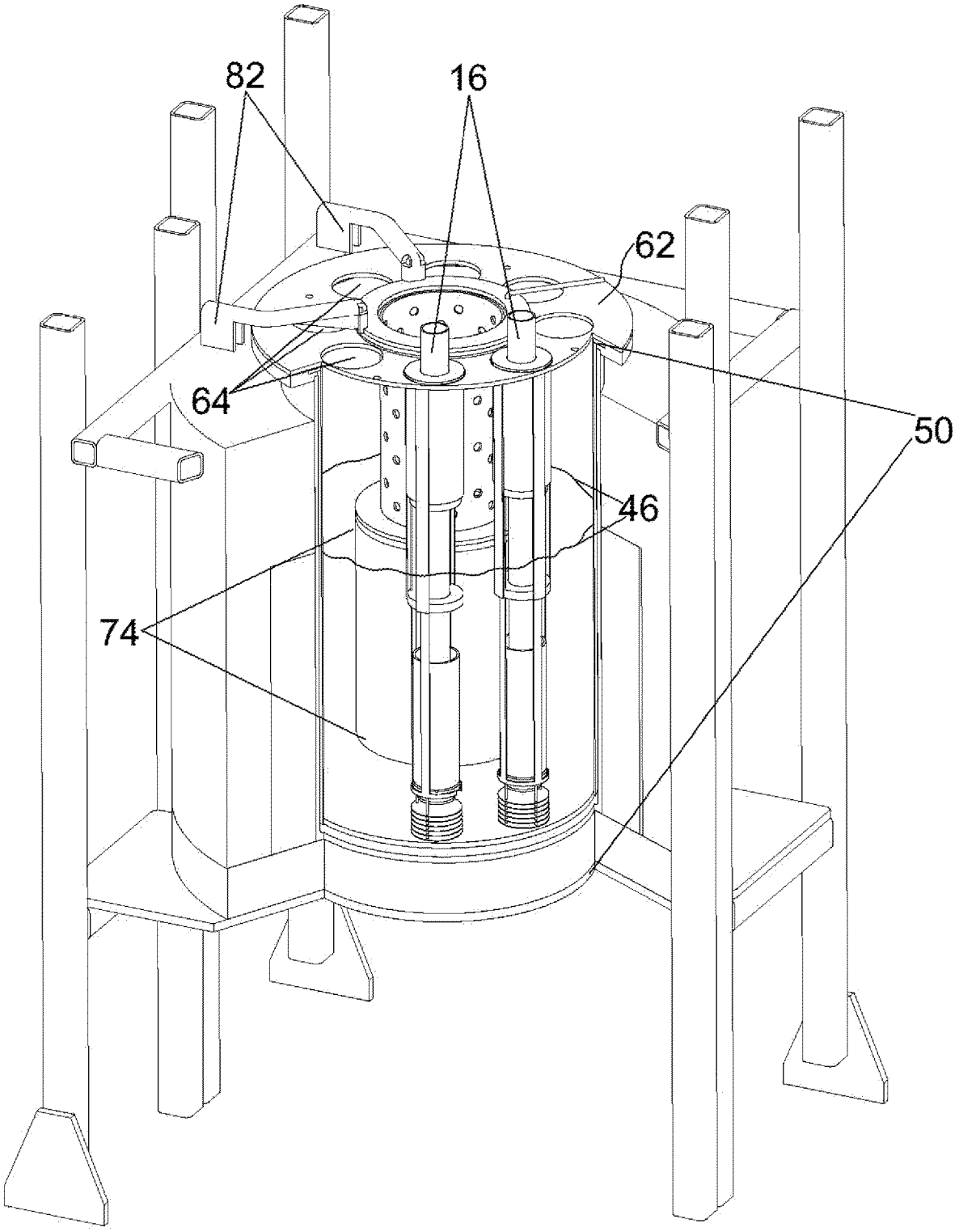
FIG. 4 is a perspective view of an anode assembly nested within a electrolyte bath vessel, in accordance with features of the present invention.

FIG. 4 shows the anode assembly 70 nested within the vessel 50 so as to be encapsulated by the vessel. The salt level 46 is at a level to cover the majority of the active material region 74 of the anode, but the level is below the weldment portion 72.

As noted supra, the anode bus bars 82 are connected directly to the superior weldment flange 78. Conversely, the cathodes are reversibly and flexibly attached to a power source. Flexible power connections are conferred via pin and socket configurations so as to allow the pin location to float for proper alignment of the cathodes with their respective apertures 64, 65 of the vessel lid.

Also located on top of the vessel cover is an off-gas collection system. The system may subject the headspace of the vessel to a negative pressure. For example, such a system may comprise a thin walled tube serving as a manifold. Depending from the manifold is a plurality of tubes extending into the gas space and terminating just above the salt level. A vacuum pull is applied to the tube, for example attachment of the remote end of the tube (e.g., that end not within the void space of the vessel) to a vacuum pump to draw out off-gas, and feed same to the scrubbers. The scrubbing step is designated as numeral 29 in FIG. 1.

The actinide cathode assemblies are separate and distinct from the rare earth cathode assemblies. However, both assemblies are adapted to be slidably received by the cathode apertures 64, 65. The assemblies are unique to the invention, and fully disclosed in applicant's U.S. utility patent application filed on Apr. 29, 2016 (Ser. No. 15/143,173) the entirety of which is incorporated herein by reference.

The first operation in the sequence of operations in the drawdown vessel is actinide drawdown, so designated as numeral 30 in FIG. 1. The actinide cathodes are lowered into the vessel and connected to their respective bus bars. As a current is applied to the system, actinide metals are deposited, from the actinide metal ions present in the salt, at the actinide cathodes and chlorine gas is generated at the anode. After the actinides have been removed from the salt, the actinide cathodes are raised above the salt level but left in the drawdown vessel 50 for use in oxidant production.

The next operation in the sequence is rare earth drawdown, so depicted as numeral 34 in FIG. 1. The rare earth cathodes are lowered into the vessel and connected to their respective bus. The operation is performed similarly to actinide drawdown with a current increase (and/or a more negative potential) applied across a shared central anode and distributed amongst the four cathodes connected to the bus feeds. When complete, the rare earth cathodes are raised above the drawdown vessel. As each cathode is removed to the waste salt transport station, an empty cathode stored in a rack alongside is inserted in its place. After all four cathodes have been replaced, the rare earth cathodes are lowered to a position above the salt to seal the open penetrations.

Oxidant Basket

Detail

Figure 5:
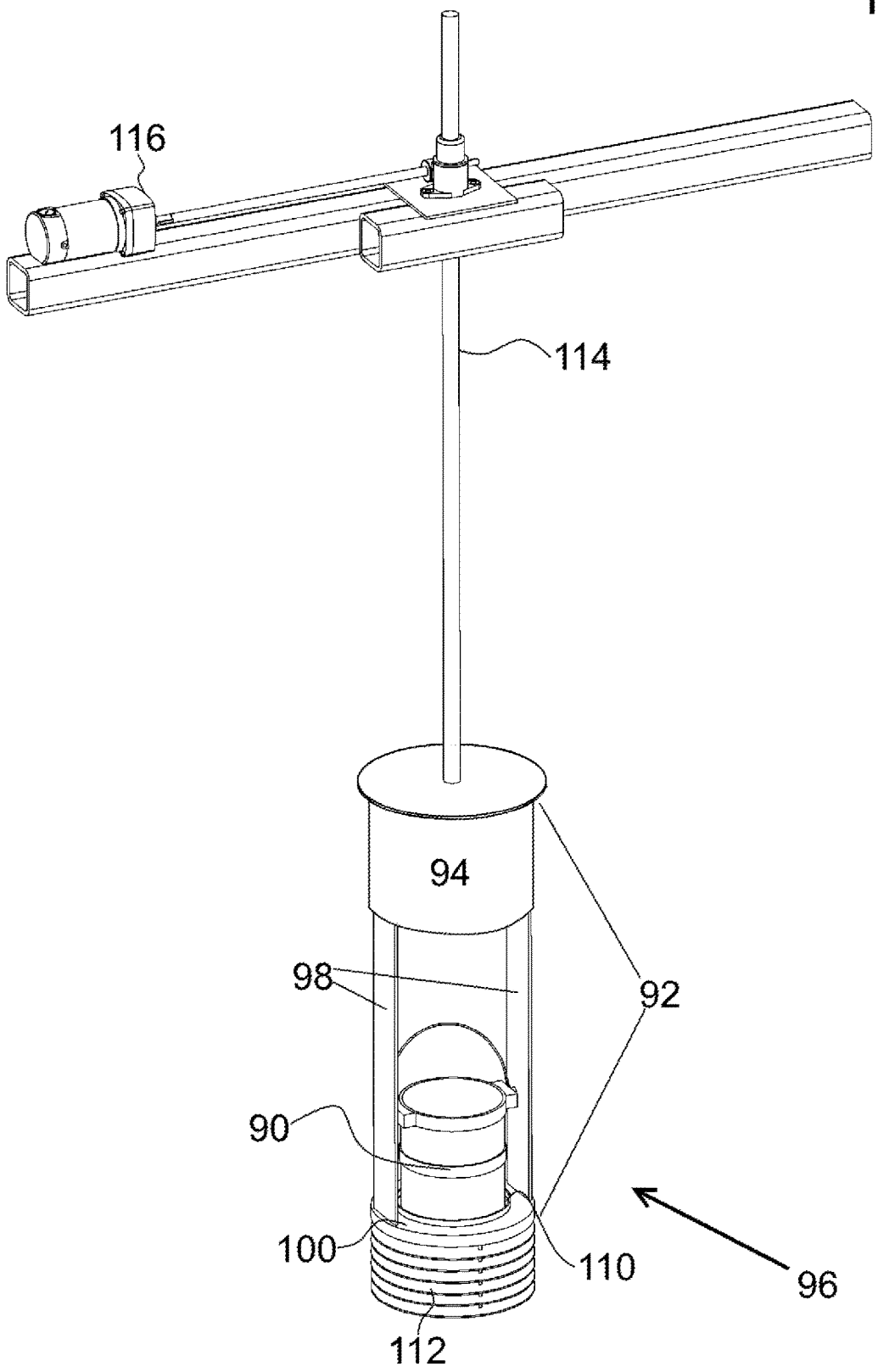
FIG. 5 is a perspective view of a metal insertion basket system, in accordance with features of the present invention.

The third operation is to oxidize the captured actinides for reuse in the salt. To generate the amount of oxidant required by the electrorefiner 22, uranium must be added along with the recovered actinides to the system to achieve correct mass balance viz Equation 4 supra. This uranium/recovered actinides addition step is designated as numeral 35 in FIG. 1. To fulfill this demand an oxidant production basket (numeral 90 in FIGS. 5 and 6) is utilized to accept uranium from the uranium processor. A scale, or some other means for measuring mass, is used to meter the correct amount of material into the basket. The oxidant production basket assembly (FIG. 5) is then brought to the drawdown vessel 50 via an overhead robot or crane. The crane sets the basket in an oxidant basket cradle 92, which is lowered into and subsequently raised out of the drawdown vessel.

This oxidant production operation begins with the loaded-up actinide cathodes and the uranium-filled oxidant production basket lowered into the drawdown vessel so as to be immersed in the salt. Chlorine gas is then directed to and contacted with the active anode material 74 (e.g. graphite). Inasmuch as the graphite is immersed in the salt, the active anode material (and therefore the chlorine gas) is electrically connected to the now submerged drawdown cathodes and the uranium basket. As the chlorine gas contacts the uranium/transuranic materials, an oxidation reaction occurs whereby the metals are chlorinated to salt-soluble metal chlorides. This reaction replenishes the actinide trichlorides in the salt. The now actinide trichloride-enriched salt is vacuum transferred to an oxidant storage tank or some other holding means where it can be pressure transferred back to the electrorefiner (item 22 in FIG. 1).

The basket cradle 92 consists of a cylindrically shaped upper insulation section 94, which maintains 150° C. on the top surface of the vessel cover 62. A bottom section 96 of the cradle is rigidly attached to the upper insulation section via a plurality of struts 98, whereby the struts contact downwardly facing surfaces of the periphery of the upper insulation section 94. In an embodiment of the invention, the struts are mounted to the insulation section 94 and the bottom section of the cradle such that the laterally facing surfaces of the insulation section 94 are contiguous with the longitudinally extending regions of the struts. A depending end of the bottom section 96 terminates in a plate (e.g., a metal or ceramic plate 1" thick×13" diameter) 100 which includes a centering ring or countersunk region 110 having a cross section larger than the oxidant production basket. This dimensioning allows for the basket to nest within the countersunk region, and perhaps frictionally engage with the periphery of the countersunk region 110. The aforementioned struts may be similarly mounted to the plate 100 such that the laterally facing surfaces of the struts and plate are contiguous.

Figure 6:
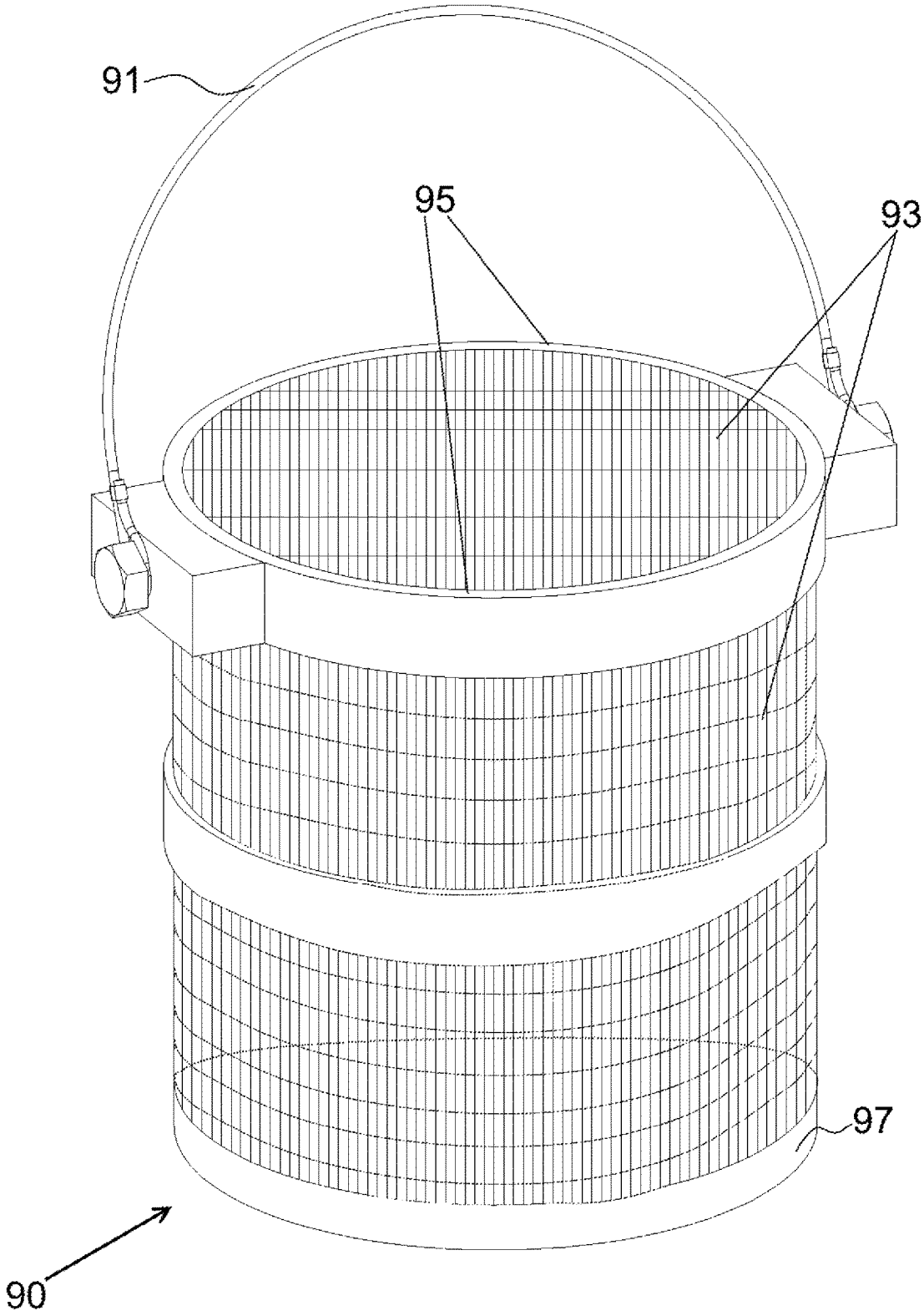
FIG. 6 is a perspective view of a metal insertion basket, in accordance with features of the present invention.

Below the centering plate 100 are several heat shields 112 that block the opening while a basket 90 is being removed or replaced. FIG. 6 depicts an exemplary basket 90. The basket features a handle 91 in rotatable communication with a periphery 95 of the basket, the periphery defining the basket opening. The basket 90 further comprises a solid bottom 97 and perforated sides 93. The perforated sides provide a means for facilitating chemical communication between the electrolyte residing outside the basket and materials loaded in the basket.

The assembly is raised and lowered into the salt with a vertical screw 114 and drive 116 positioned on an upper support of the main frame. Preferably, trapezoidal screws and drives are utilized (such as Acme thread forms), inasmuch as such trapezoidal configurations embody larger root mass, and therefore can carry larger loads compared to square screw configurations.

Salt Waste

Treatment Detail

When the fuel treatment process has approached steady state (and after the actinides and rare earths have been deposited on cathodes), salt in the residual salt vessel 33 contains chlorides of only the active metal fission products, for example Rb, Sr, Cs, Ba, Sm, and Eu. A portion of this salt 33 FIG. 1 is discharged to a waste salt treatment process 38.

This system consists of a salt storage tank, a salt crystallization vessel, a waste salt transport station, and a salt transport tank. Salt from the final drawdown process 34 vessel is first transferred to the storage tank 33 from where it is transferred to the salt crystallization tank. The salt is treated in the salt crystallization vessel to separate salt concentrated in fission products from salt having reduced fission product concentration, the later of which is returned to oxidant production, the electrolytic reducer, or the refiner. In the waste salt transport station, the salt with concentrated fission products is combined with rare earth metals. The combined materials are discharged into the salt transport tank and transferred to the waste treatment cell to produce the ceramic waste form.

In summary, the invented method and process facilitates recovery of all actinides for the portion of salt transferred from an electrorefiner to a drawdown vessel.

This recovery operation utilizes electrolysis, which deposits the actinides as metals on a cathode and generates chlorine gas at the anode. (In order to recover all the actinides during the actinide drawdown operation, some fraction of the rare earths will be deposited with the actinides.)

- The actinide drawdown cathodes are raised out of the salt and stored in the vessel in the gas space above the molten salt.
- The rare earth collection cathodes are then lowered into the salt and the electrolysis operation is continued. (This time the rare earths co-deposit as metals on the cathode and chlorine gas is evolved at the anode.)
- When the rare earth drawdown operation reaches an endpoint, the rare earth collection cathodes are removed from the vessel and passed on to the waste processing operation.
- Most of the salt in the vessel is then pumped out to another vessel in which the active metal (Cs, Ba, Sr, Eu, Sm) fission products are removed from the molten salt.
- The bulk of the salt is then pumped back into the drawdown vessel for the oxidant production (actinide chlorination) step.
- The actinide drawdown cathodes along with some additional uranium metal in a conductive basket are lowered into the molten salt.
- A dilute stream of chlorine gas is sparged into the salt such that the gas bubbles rise and contact a high surface area graphite electrode. (The graphite electrode is electrically connected to the uranium basket and the actinide drawdown electrodes via an external electrical connection.) This arrangement converts the chlorine gas to chloride ions and the actinide metals and uranium metal to metal ions. The reaction is spontaneous so that no applied potential is needed.
- When all the uranium and actinide drawdown products have been converted to metal ions, the gas flow is turned off.
- The molten salt is then pumped back to the electrorefiner.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments.

Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The invention claimed is:

1. A method for recycling molten salt from electrorefining processes, the method comprising:

a) providing a single vessel containing a molten salt electrolyte bath comprising actinide metal ions therein;

b) collecting actinide metals onto a first plurality of cathodes immersed in the molten salt electrolyte bath, wherein the cathodes are maintained at a first voltage potential;

c) removing the first plurality of cathodes from the molten salt electrolyte bath and inserting a second plurality of cathodes into the molten salt electrolyte bath;

d) maintaining the second plurality of cathodes at a second voltage potential that is more negative than the first potential to cause rare earth metal to collect onto the second plurality of cathodes;

e) removing the second plurality of cathodes from the molten salt electrolyte bath;

f) inserting the first plurality of cathodes with collected actinide metals and adding uranium metal into the molten salt electrolyte bath; and g) chlorinating the inserted actinide metals and added uranium metal within the single vessel, wherein actinide metal ions are replenished within the molten salt electrolyte bath.

2. The method as recited in claim 1 wherein the chlorinating step utilizes chlorine gas generated during the collecting steps.

3. The method as recited in claim 1 wherein the actinide metals are collected on the first plurality of cathodes at a first temperature.

4. The method as recited in claim 3 wherein the rare earth metal is collected on the second plurality of cathodes at a second temperature.

5. The method as recited in claim 4 wherein the second temperature is higher than the first temperature.

6. The method as recited in claim 2 wherein the chlorine gas is injected into the bottom of the molten salt electrolyte bath from interior regions of an anode while the first plurality of cathodes is in the molten salt electrolyte bath and electrically connected to the anode.

7. The method as recited in claim 1 wherein the first plurality of cathodes remains in the vessel and not immersed in the molten salt electrolyte bath while the second plurality of cathodes is in the molten salt electrolyte bath.

8. The method as recited in claim 1 wherein cathodes comprising the second plurality of cathodes are different from cathodes comprising the first plurality of cathodes.

9. The method as recited in claim 1 wherein the rare earth metal is used as feedstock for ceramic waste forms.

* * * * *